US005538340A

United States Patent [19]

Brashears

[11] Patent Number: 5,538,340

[45] Date of Patent: Jul. 23, 1996

[54] COUNTERFLOW DRUM MIXER FOR MAKING ASPHALTIC CONCRETE AND METHODS OF OPERATION

[75] Inventor: David F. Brashears, Belle Isle, Fla.

[73] Assignee: Gencor Industries, Inc., Orlando, Fla.

[21] Appl. No.: 166,030

[22] Filed: Dec. 14, 1993

[51] Int. Cl.[6] ..... B28C 5/46

[52] U.S. Cl. ..... 366/25; 366/147; 432/103

[58] Field of Search ..... 366/25, 4, 23, 366/22, 24, 7, 144, 147; 432/103, 105, 109; 106/281.1, 282, 284; 110/246

[56] References Cited

U.S. PATENT DOCUMENTS

| | | |
|---|---|---|
| Re. 22,502 | 7/1933 | Wood . |
| Re. 29,496 | 12/1977 | Dydzyk . |
| Re. 31,904 | 6/1985 | Mendenhall . |
| Re. 31,905 | 6/1985 | Mendenhall . |
| 470,159 | 3/1892 | Warren . |
| 600,597 | 3/1898 | Rissmuller . |
| 616,014 | 12/1898 | Robbins . |
| 711,115 | 10/1902 | Lober . |
| 725,641 | 4/1903 | Ash . |
| 725,642 | 4/1903 | Ash . |
| 757,387 | 4/1904 | Ash . |
| 779,197 | 1/1905 | Ash . |
| 779,198 | 1/1905 | Ash . |
| 863,096 | 8/1907 | Rufli . |
| 887,906 | 5/1908 | Ash . |
| 917,702 | 4/1909 | Ash . |
| 1,041,226 | 10/1912 | Ames . |
| 1,067,210 | 7/1913 | Ash . |
| 1,069,243 | 8/1913 | Fogler . |
| 1,187,959 | 6/1916 | Ash . |
| 1,189,772 | 7/1916 | Ammann . |
| 1,205,948 | 11/1916 | Popkess . |
| 1,232,724 | 7/1917 | Seelbach . |
| 1,240,481 | 9/1917 | Popkess . |
| 1,332,987 | 3/1920 | Julian et al. . |
| 1,569,605 | 1/1926 | Ash . |
| 1,637,889 | 8/1927 | Ash . |
| 1,654,358 | 12/1927 | Ash et al. . |
| 1,654,359 | 12/1927 | Ash . |
| 1,698,454 | 1/1929 | Schaaf . |
| 1,703,635 | 2/1929 | Ranson . |
| 1,774,649 | 9/1930 | Hepburn et al. . |
| 1,836,261 | 12/1931 | Madsen . |
| 1,836,754 | 12/1931 | Hepburn . |
| 1,954,997 | 4/1934 | Hirzel . |

(List continued on next page.)

FOREIGN PATENT DOCUMENTS

| | | |
|---|---|---|
| 0391768 | 10/1990 | European Pat. Off. . |
| 0362199B1 | 4/1992 | European Pat. Off. . |
| 762159 | 2/1934 | France . |
| 758470 | 3/1934 | France . |
| 2202982 | 5/1974 | France . |
| 2293524 | 8/1976 | France . |
| 2102328 | 4/1975 | Germany . |
| 2446579 | 7/1979 | Germany . |
| 3423521 | 6/1984 | Germany . |
| 1439420 | 6/1976 | United Kingdom . |
| 1443424 | 7/1976 | United Kingdom . |

*Primary Examiner*—Robert W. Jenkins
*Attorney, Agent, or Firm*—Nixon & Vanderhye

[57] ABSTRACT

An inclined counterflow rotating drum mixer has a burner head intermediate an aggregate inlet at one end of the drum and an asphaltic concrete discharge at the opposite end of the drum. A fan supplies secondary air to the burner through a motive tube having an opening in communication with a mixing chamber between the burner head and the discharge end of the drum to aspirate gases from the mixing chamber for flow through the burner flame. The aspiration creates a negative pressure in the mixing chamber, causing a reverse flow of a portion of the combustion gases from the dryer chamber into the mixing chamber for preheating RAP input to the mixing chamber. RAP is also preheated by providing a preheat chamber adjacent the flame zone but segregated from direct contact with the flame to preheat the RAP. Hot and dried virgin aggregate is mixed with the RAP in the preheat chamber and valves are provided to prevent gases evolved from the RAP in the preheat chamber from flowing into the drying chamber.

9 Claims, 6 Drawing Sheets

U.S. PATENT DOCUMENTS

| | | | |
|---|---|---|---|
| 1,960,463 | 5/1934 | Taylor . | |
| 1,997,959 | 4/1935 | Wood . | |
| 2,037,907 | 3/1937 | Scullin . | |
| 2,111,908 | 3/1938 | Andrews . | |
| 2,209,710 | 7/1940 | Wood . | |
| 2,257,637 | 9/1941 | Moore . | |
| 2,285,765 | 6/1942 | Carswell . | |
| 2,305,938 | 12/1942 | Turnbull . | |
| 2,390,509 | 12/1945 | Carter . | |
| 2,421,345 | 5/1947 | McConnaughay . | |
| 2,473,347 | 6/1949 | Sanborn . | |
| 2,484,911 | 10/1949 | Seil . | |
| 2,701,213 | 2/1955 | Neville . | |
| 2,923,538 | 2/1960 | Schoonover . | |
| 3,111,979 | 11/1963 | Peoples . | |
| 3,133,812 | 5/1964 | Moklebust . | |
| 3,180,631 | 4/1965 | Moklebust . | |
| 3,227,202 | 1/1966 | Morgan . | |
| 3,249,452 | 5/1966 | Plumb . | |
| 3,260,389 | 7/1966 | Paton . | |
| 3,349,826 | 10/1967 | Poole et al. . | |
| 3,352,702 | 11/1967 | Leitner et al. . | |
| 3,423,222 | 1/1969 | McConnaughay . | |
| 3,436,061 | 4/1969 | Zinn . | |
| 3,547,411 | 12/1970 | Sowell . | |
| 3,614,071 | 10/1971 | Brock . | |
| 3,693,945 | 9/1972 | Brock . | |
| 3,716,002 | 2/1973 | Porter et al. . | |
| 3,832,201 | 8/1974 | Shearer . | |
| 3,840,215 | 10/1974 | McConnaughay . | |
| 3,845,941 | 11/1974 | Mendenhall . | |
| 3,866,888 | 2/1975 | Dydzyk . | |
| 3,868,262 | 2/1975 | Ohlson . | |
| 3,868,263 | 2/1975 | McConnaughay . | |
| 3,971,666 | 7/1976 | Mendenhall . | |
| 3,975,002 | 8/1976 | Mendenhall . | |
| 3,999,743 | 12/1976 | Mendenhall . | |
| 4,000,000 | 12/1976 | Mendenhall . | |
| 4,003,693 | 1/1977 | Straitz, III . | |
| 4,025,057 | 5/1977 | Shearer . | |
| 4,034,968 | 7/1977 | Mendenhall . | |
| 4,066,247 | 1/1978 | Mendenhall . | |
| 4,067,552 | 1/1978 | Mendenhall . | |
| 4,074,894 | 2/1978 | Mendenhall . | |
| 4,075,710 | 2/1978 | Jakob et al. . | |
| 4,095,284 | 6/1978 | Mendenhall . | |
| 4,096,588 | 6/1978 | Mendenhall . | |
| 4,128,631 | 12/1978 | Lundmark et al. . | |
| 4,130,364 | 12/1978 | Brown . | |
| 4,147,436 | 4/1979 | Garbelman et al. . | |
| 4,165,184 | 8/1979 | Schlarmann . | |
| 4,174,181 | 11/1979 | Garbelman et al. . | |
| 4,177,080 | 12/1979 | Mendenhall . | |
| 4,182,631 | 1/1980 | Mendenhall . | |
| 4,183,885 | 1/1980 | Marazzi . | |
| 4,189,238 | 2/1980 | Mendenhall . | |
| 4,191,546 | 3/1980 | Kroyer . | |
| 4,211,490 | 7/1980 | Brock et al. . | |
| 4,215,941 | 8/1980 | Mendenhall . | |
| 4,230,449 | 10/1980 | Binasik et al. . | |
| 4,234,346 | 11/1980 | Latta, Jr. et al. . | |
| 4,238,241 | 12/1980 | Schneider . | |
| 4,255,058 | 3/1981 | Peleschka et al. . | |
| 4,286,944 | 9/1981 | Labriot et al. . | |
| 4,300,837 | 11/1981 | Malbrunot . | |
| 4,309,113 | 1/1982 | Mendenhall | 366/4 |
| 4,318,619 | 3/1982 | Schlarmann . | |
| 4,318,620 | 3/1982 | Malipier et al. . | |
| 4,347,052 | 8/1982 | Reed et al. . | |
| 4,395,129 | 7/1983 | Musil . | |
| 4,481,039 | 11/1984 | Mendenhall . | |
| 4,522,498 | 6/1985 | Mendenhall . | |
| 4,600,379 | 7/1986 | Elliott . | |
| 4,787,938 | 11/1988 | Hawkins . | |
| 4,797,002 | 1/1989 | Heap . | |
| 4,867,572 | 9/1989 | Brock et al. . | |
| 4,913,552 | 4/1990 | Bracegirdle . | |
| 4,919,538 | 4/1990 | Swisher . | |
| 4,988,207 | 1/1991 | Marconnet . | |
| 4,989,986 | 2/1991 | Swisher | 366/25 |
| 5,054,931 | 10/1991 | Farnham et al. . | |

COUNTERFLOW DRUM MIXER FOR MAKING ASPHALTIC CONCRETE AND METHODS OF OPERATION

TECHNICAL FIELD

The present invention relates to a drum mixer for heating and drying aggregate and mixing the aggregate with liquid asphalt and/or recycled asphalt product to form asphaltic concrete and particularly relates to a counterflow drum mixer with hot gas stream recirculation and preheat of recyclable asphaltic product.

BACKGROUND

Many and various types of drum mixers for making asphaltic concrete have been known, proposed and/or used in the past. One such drum mixer has an inclined drum rotatable about its axis and having an inlet at its upper end and an asphaltic concrete product outlet at its lower end. A burner assembly extends through the breeching at the lower end of the drum and mounts a burner head spaced from the lower drum end to define a drying chamber between the burner head and the aggregate inlet and an annular mixing chamber between the burner head and the asphaltic concrete product outlet. Flighting is typically spaced circumferentially about and longitudinally along the interior wall of the drying section of the drum to carry and veil aggregate input to the drum at its upper end. Hot gases of combustion from the burner flame flow in the drying section concurrently to the direction of flow of the aggregate through the drum, the hot gases flowing through the veiling aggregate to remove dust and moisture from the aggregate and exiting the drum for flow to a separator, e.g., a baghouse.

The mixing section comprises the annular chamber between the burner tube assembly projecting into the drum from its lower end wall and the drum walls. A liquid asphalt pipe extends into the mixing chamber for discharging liquid asphalt onto the dried aggregate flowing into the mixing chamber whereby the dried aggregate and asphalt form asphaltic concrete.

Used or recycled asphaltic product and/or mineral filler, dust and/or additives may also be disposed in the drum for mixing in the mixing chamber with the aggregate whereby the asphaltic concrete comprises virgin aggregate and recycled asphaltic product and with/or without applied liquid asphalt. Drums of this type have been successfully used for many years in the asphalt industry. A recurring and constant problem whenever asphalt and hot gases or flame are used in conjunction with one another is the "blue smoke" generated by the burning and/or volatilization of the asphalt. This causes environmental problems and it is therefore highly desirable to eliminate any production of blue smoke. Additionally, efficiencies in heating the virgin aggregate, as well as the recycled asphaltic product, are also highly desirable in view of the large tonnage of materials passing through the mixer.

DISCLOSURE OF THE INVENTION

To increase the efficiency and eliminate the foregoing and other problems associated with prior drum mixers of this type, the present invention provides a novel and improved drum mixer having various advantages in construction, operation and efficiencies as compared with such prior mixers. Particularly, the present invention provides a drum mixer of the foregoing type wherein the burner tube assembly includes a central atomizing tube for feeding high pressure atomization air to the burner head, a first concentric bypass air tube about the high pressure tube for feeding bypass air into the burner flame, and a second concentric motive air tube about the bypass air tube for providing additional motive air to the burner flame. The motive air tube also forms part of an eductor system for circulating hot gases from the hot gas stream in the dryer section into the annular mixing section and then into the flame zone. As will be appreciated, steam, particulate matter and volatile gases are often present in the mixing chamber. By employing a motive air tube having an opening or a gap in communication with the mixing chamber, the hot gases within the mixing chamber can be aspirated into the motive air tube to mix with ambient motive air and increase their oxygen content such that premixed heated gases flow into the flame for combustion of any residual hydrocarbons in the gases in the mixing chamber. Motive air may, for example, be provided by a fan external to the drum which supplies a blast of air through the rear breeching of the drum and into the motive air tube. A valving mechanism adjustable externally of the drum is employed to regulate the flow of hot gases aspirated from the mixing chamber into the motive air tube and hence into the flame. Thus, any volatiles in the mixing chamber may be supplied directly to the burner for incineration.

Additionally, by adjusting the valve, a portion of the hot gases of combustion in the drying section may be reversed in flow direction and drawn into the mixing section. That is, a negative pressure is induced in the mixing section by the aspiration of the motive air en route to the burner as compared with a higher pressure in the drying section. This pressure differential causes a portion of the hot gases in the drying section to reverse their flow direction and to flow concurrently with the aggregate into the mixing section.

It will be appreciated with the burner head intermediate the ends of the drum, combustion air must be supplied to the burner to provide the oxygen necessary for combusting the fuel. Simultaneously, the combustion that occurs in a flame zone adjacent the burner head causes a high radiant heat transfer to the drum shell. This, in combination with the heated aggregate flowing through the drum can cause the drum shell to reach elevated temperatures with the possibility of damage to the drum shell and surrounding equipment, as well as posing a safety hazard. In another aspect of the present invention, secondary combustion air may be drawn into the flame radially of the drum by an outer or an inner shell defining an annular chamber open to the atmosphere at one end for aspirating air radially inwardly into the flame zone. In one form, an outer shell surrounds the drum and defines an annular chamber about the drum where ambient air is preheated by the drum wall, hence cooling the drum wall. The preheated air is then directed from the annular chamber into the flame zone. Heat losses through the drum wall at its hottest areas are thus minimized and advantageously provide preheated air to the burner. The drum wall temperature is minimized and other metal surfaces are exposed to a reduced temperature. Alternatively, the annular chamber can be provided by an inner wall spaced from the interior wall of the drum and similar results obtain. As well known, preheated air supplied to a burner enhances combustion performance. An additional enhancement in performance is obtained by providing the preheated air to the flame zone through radially inwardly directed spokes configured to impart a circular motion or swirl to the air as the preheated air enters the flame zone.

A recycle asphalt product inlet wheel is mounted on the drum to admit recycled asphalt material (RAP) into the mixing section. In one embodiment, the recycle inlet is behind the flame zone to admit RAP directly into the mixing chamber. In a further embodiment, RAP is disposed into an annular space about the drum, either exterior or interior, along the drying section adjacent to or in front of the flame. The recycle material is thus preheated by radiant heat from the flame and may flow along and within the annular zone past the flame for discharge directly into the mixing chamber. The recycle material is thus protected from the flame by the drum wall or the wall of the annulus, as the case may be.

While it is highly desirable to preheat the recycle asphaltic material to some extent, the RAP material in contact with the hot inner wall of the drum might tend to stick to the wall and form a carbonaceous deposit on the wall which would inhibit heat transfer. It could also break off from the wall in large chunks of material, causing hard oversized chunks in the final asphaltic mix. To preclude problems of this type in the present invention, it has been discovered that a portion of the virgin aggregate can be combined with the recycle asphaltic product in a RAP preheat chamber to maintain the preheat chamber clean. Preferably, the virgin aggregate supplied to the preheat chamber is transmitted from the drying section into the preheat chamber whereby the aggregate mixing with the RAP material in the preheat chamber is hot and dry. The hot and dry aggregate thus cleans the preheat chamber while it simultaneously mixes with and transfers heat to the RAP material. A preheated mix of RAP and virgin aggregate is therefore supplied the to mixing chamber. There is no need for additional conveyors, feed bins or controls external to the drum system to supply the virgin aggregate to the preheat chamber. The quantity of aggregate entering the preheat chamber from the drying section can be controlled by valve action at the inlet to the preheat chamber. It will also be appreciated that gases evolving from the RAP being preheated in the preheat chamber are vented into the mixing chamber and prevented from escaping into the dryer section, which would cause a pollution problem. Various types of valving arrangements are provided in accordance with the ensuing description to permit inflow of virgin aggregate into the preheat chamber for premixing and preheating with RAP while preventing outflow of gases from the preheat chamber into the drying section.

In a preferred embodiment according to the present invention, there is provided a drum mixer for the production of asphaltic concrete comprising a rotatable drum having an inlet adjacent a first end of the drum for receiving aggregate for flow along the drum toward a second end of the drum opposite the first end, with an outlet adjacent the second end for discharging asphaltic concrete and a burner disposed in the drum having a burner head for generating a flame defining a combustion volume and located intermediate the first and second ends of the drum, the burner head dividing the drum into a drying chamber between the burner head and the first end of the drum and a mixing chamber between the burner head and the second end of the drum, the burner head generating hot combustion gases for flow through the drying chamber toward the first end of the drum in countercurrent flow relation to the flow of aggregate from the first end through the drying chamber toward the second end of the drum for drying the aggregate. Also provided are a conduit for supplying liquid asphalt in the mixing chamber for mixing with the aggregate heated by the hot gases of combustion and forming the asphaltic concrete, a source of air under pressure, and a first conduit in communication with the source of air under pressure for supplying air to the combustion volume and having an opening in communication with the mixing chamber for aspirating gases within the mixing chamber for flow toward and into the combustion volume.

In a further preferred embodiment according to the present invention, there is provided a method for making asphaltic concrete comprising the steps of introducing aggregate adjacent a first end of a drum mixer for flow toward a second opposite end of the drum mixer, locating a burner head within the drum mixer intermediate the drum ends defining a drying chamber for the aggregate between the burner head and the first end of the drum mixer and a mixing chamber between the burner head and the second end of the drum mixer, generating hot gases of combustion at the burner head for flow through the drying chamber countercurrently to the flow of aggregate through the drum mixer, mixing hot and dried aggregate with asphalt in the mixing chamber to produce asphaltic concrete and flowing gases from the mixing chamber into a combustion volume generated by the burner head.

Accordingly, it is a primary object of the present invention to provide a novel and improved counterflow drum mixer and methods of operation for providing preheated air from the mixing zone to the flame zone, preheated RAP to the mixing zone and recirculating hot gases of combustion from the drying section to the mixing zone into the flame zone to improve the efficiency of the process and minimize or eliminate the pollutants extant in processes of this type.

BEST MODE FOR CARRYING OUT THE INVENTION

Figure 1:
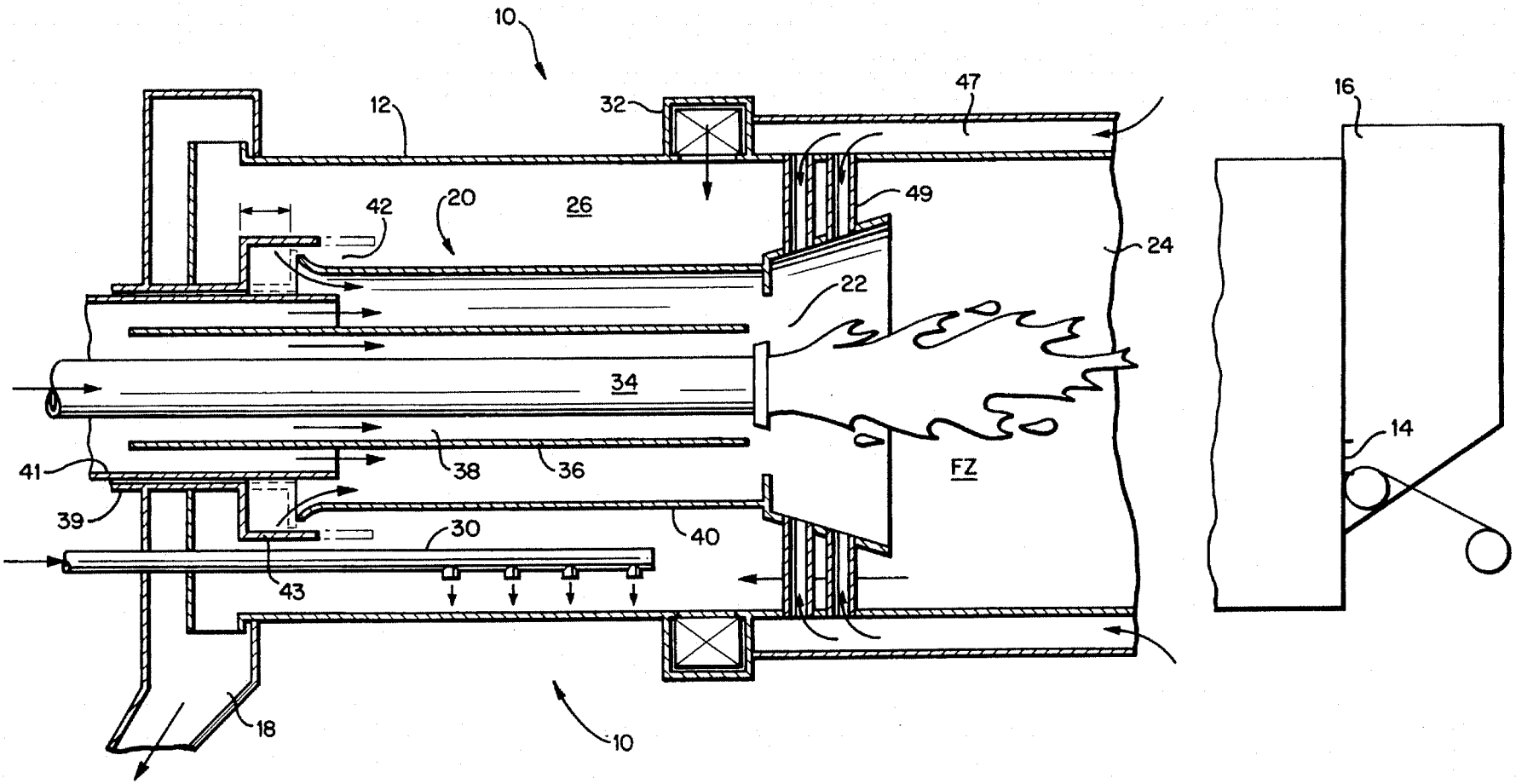
FIG. 1 is a schematic longitudinal cross-sectional view with parts broken out and in cross-section illustrating a counterflow drum mixer according to the present invention.

Referring now to the drawings, particularly to FIG. 1, there is illustrated a counterflow drum mixer, generally designated 10. As will be appreciated, drum mixer 10 includes a cylindrical drum 12 mounted on rollers, not shown, in a generally horizontal, inclined, position and rotatable about its axis. More particularly, drum 12 has an inlet 14 at its upper end for supplying aggregate into the drum. Also illustrated at the upper end of the drum is an exhaust gas outlet 16 for receiving the hot gases from the drum and passing those gases onto a baghouse, not shown, for cleaning and eventual release to the atmosphere. The lower or downstream end of the drum has an asphaltic product discharge 18 for discharging the finished hot mix onto an elevator for conveyance into a storage silo or to an awaiting truck.

A multiple tube burner assembly, generally designated 20, extends through the breeching at the lower drum end and mounts a burner head 22 intermediate the ends of the drum and which burner head generates a flame in a flame zone FZ or combustion volume. The burner head is thus located to define a drum drying section or chamber 24 between the burner head 22 and the aggregate inlet end of the drum, as well as a mixing section or chamber 26 located between the burner head 22 and the hot mix discharge end of the drum. As illustrated, the mixing chamber 26 is an annular chamber defined between the walls of the drum and the outer wall of the multiple tube burner assembly 20. Flights, not shown, are spaced circumferentially about and longitudinally along the interior wall of the drying section to carry and veil aggregate input to the drum at its upper end. The area of the drum surrounding the flame zone FZ has either no flights or special flights to prevent aggregate from falling through the combustion volume. Additionally, behind the burner head in the mixing zone, there are provided veiling flights followed by mixing flights terminating adjacent the discharge end of the drum. The hot gases of combustion from the burner head 22 thus flow countercurrently to the direction of flow of the virgin aggregate in the drying section and flow through the veiling aggregate to remove dust and moisture from the aggregate. The gases exit the drum through the exhaust outlet 16 en route to a baghouse. Thus, it will be seen that virgin aggregate is input to the drum through inlet 14, is dried in the drying section 24 by the hot gases of combustion from burner 22 and flows past beyond the burner head 22 into the mixing chamber 26 where the dried and clean aggregate is mixed with liquid asphalt supplied mixing chamber 26 by liquid asphalt pipe 30 or with recycled asphaltic product (RAP) input to the mixing chamber 26 by way of RAP inlet 32, or both. The liquid asphalt supply pipe 30 has a multiplicity of nozzles for spraying liquid asphalt onto the aggregate accumulating at the bottom of the rotating drum whereby the aggregate and liquid asphalt are thoroughly mixed upon rotation of the drum. Advantageously, dust and other particulate matter are entrained in the asphalt spray as it is applied to the aggregate. The specific construction of the recycle inlet 32 to the rotary drum is well known in the art and details thereof are not set forth herein.

Burner tube assembly 20 includes a central atomizing tube 34 for feeding high pressure air to the burner head 22. A bypass tube 36 concentrically surrounds the high pressure tube 34 defining an annular bypass passage 38 therebetween for feeding bypass air into the burner flame. Concentrically surrounding and spaced from the bypass tube 36 is a motive air tube 40 for providing additional air to the burner flame. The motive air tube 40 comprises part of an eductor system for circulating hot gases from the hot gas stream in the dryer section through the annular mixing section 26 and into the flame zone whereby the mixing zone temperature is advantageously elevated and unburned volatiles in the mixing chamber are carried through the motive air tube into the flame. Particularly, the motive air tube 40 includes a gap or opening 42, preferably annular, in communication between the mixing chamber 26 and the annular chamber between tubes 36 and 40. By providing a fan external to the drum for supplying high velocity air to the motive channel, it will be appreciated that the high momentum motive air causes aspiration of gases from the mixing chamber 26 through the opening 42 into the motive air channel. Thus, clean ambient air mixes with the heated gases of the mixing chamber containing volatiles, steam and particulate matter and flows that combination into the flame. The motive air, of course, increases the oxygen content of the gases from the mixing chamber and enables premixing thereof, allowing for more rapid and thorough combustion of any hydrocarbons in the gases. Because of the high velocity of the motive air channel, deposition of dust or other particulate matter in the motive air channel is substantially prevented. Furthermore, the eductor system can rotate with the drum, eliminating any buildup of materials inside or outside of the concentric ducts. Consequently, this arrangement provides for the aspiration of the gases, including steam and blue smoke, while minimizing the transport of particulate matter in the mixing zone, including droplets or stringers of asphalt, for supply of combustion air to the burner. This is accomplished by the provision of an eductor system having a low maintenance fan and which may be the same fan providing the combustion air to the burner system. Additionally, the fan is not exposed to the interior of the drum and because of the absence of such exposure, can be a very low maintenance device.

Additionally and advantageously, the motive air flowing through the motive air channel aspirating the gases from the mixing chamber 26 causes a reduced or negative pressure in mixing chamber 26. This negative or reduced pressure in turn causes a portion of the hot gases of combustion in the drying chamber to reverse their direction of flow from the burner toward the upper end of the drum to a flow direction parallel to the aggregate flow and into the mixing chamber. These high temperature gases, for example, on the order of 800° to 2000° F., enhance the process by supplying additional heat to the aggregate materials, including any recycled asphalt material (RAP) as those materials flow into the mixing chamber. Any returned dust collected in the plant's exhaust gas particulate clean-up system, for example, from the baghouse, may also be added to the RAP material for disposition in the mixing chamber. These materials typically would be well below the required final mix temperature. Also, the RAP may contain substantial quantities of moisture. The additional heat provided by the induction of the combustion gases from the drying chamber into the mixing chamber increases the recycling capability of the process because otherwise the energy required to heat and dry the RAP and dust would be provided solely by the hot virgin aggregates. Thus, the present invention draws a portion of the hot gases into the mixing chamber where those hot gases heat the virgin aggregate, RAP and dust. Heat transfer from the hot gases flowing from the dryer section to the mixing section may be enhanced by providing veiling flights in this section of the drum. Also, because the combustion gases are essentially void of oxygen and the steam leaving the RAP would tend to blanket the asphalt binder, oxidation of the materials is minimized or eliminated, while substantial heat transfer proceeds from the combustion gases to the aggregates.

The control of the air to the burner can also be regulated by valving the fan input of air to the motive and bypass channels. Thus, as the motive air is increased or decreased, a proportional decrease or increase, respectively, in the bypass air would result. Consequently, total combustion air supplied to the burner would be constant. A valve for this purpose may comprise a sleeve 39 arranged concentrically about an air input sleeve 41 to the motive air channel. The sleeve 39 has a radial outward and axially extending portion 43 slightly greater in diameter than the input end of motive air tube 40. By adjusting the axial extent of sleeve 39 relative to the inlet of sleeve 40, the gap 42 can be reduced or enlarged, respectively. Thus, the mix of motive air and gases from the mixing chamber supplied to the flame can be varied. Other types of valves may be employed for this purpose, e.g., a proportioning damper to proportion air in the motive air channel and the bypass air channel. Additionally, preheated ambient air may be supplied directly to the burner flame and in a manner to enhance combustion efficiencies. To accomplish this, an annular chamber 47 may be provided about the drum 12 in the vicinity adjacent the burner and upstream of the burner as illustrated in FIG. 1. An end of chamber 47 is open to the atmosphere and air supplied to the chamber is preheated by radiant air through the drum wall. At an axial location substantially corresponding to the burner head, the annular chamber 47 lies in communication with the burner flame through a plurality of circumferentially spaced tubes or spokes 49. Preferably, the tubes are disposed at an angle to a radius such that the preheated air input to the burner flame has a tangential velocity component, hence imparting a swirl to the air supplied to the burner flame.

Figure 2:
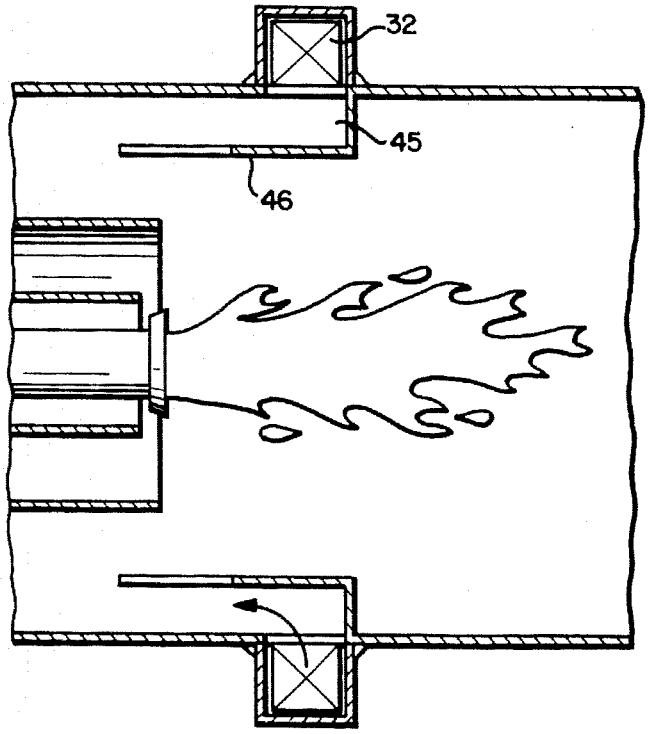
FIG. 2 is a view similar to FIG. 1 illustrating a RAP inlet to the drum at a location in front of the burner.

As previously mentioned, one of the problems associated with counterflow drum mixers is that in prior mixers of this type, the heat for drying and heating the recycled asphalt materials (RAP) introduced into the mixing zone was provided solely by the overheated virgin aggregates. A method of preheating the RAP is illustrated in FIG. 2. In that figure, an annular preheat chamber 45 is formed on the inside of the drum by a radially inner wall 46 which confines the RAP received through the RAP inlet 32 in the annular preheat chamber. The outlet from the chamber is located downstream in the direction of aggregate flow from the burner head whereby the RAP entry into the mixing zone is behind the flame and burner head. The chamber 45 is thus preheated by radiation. Note that the outside of the drum shell is protected by the preheat chamber and wall 46 from the heat of combustion. Also, dust returned from the exhaust system as previously mentioned can be entered with the RAP into preheat chamber 45.

Figure 3:
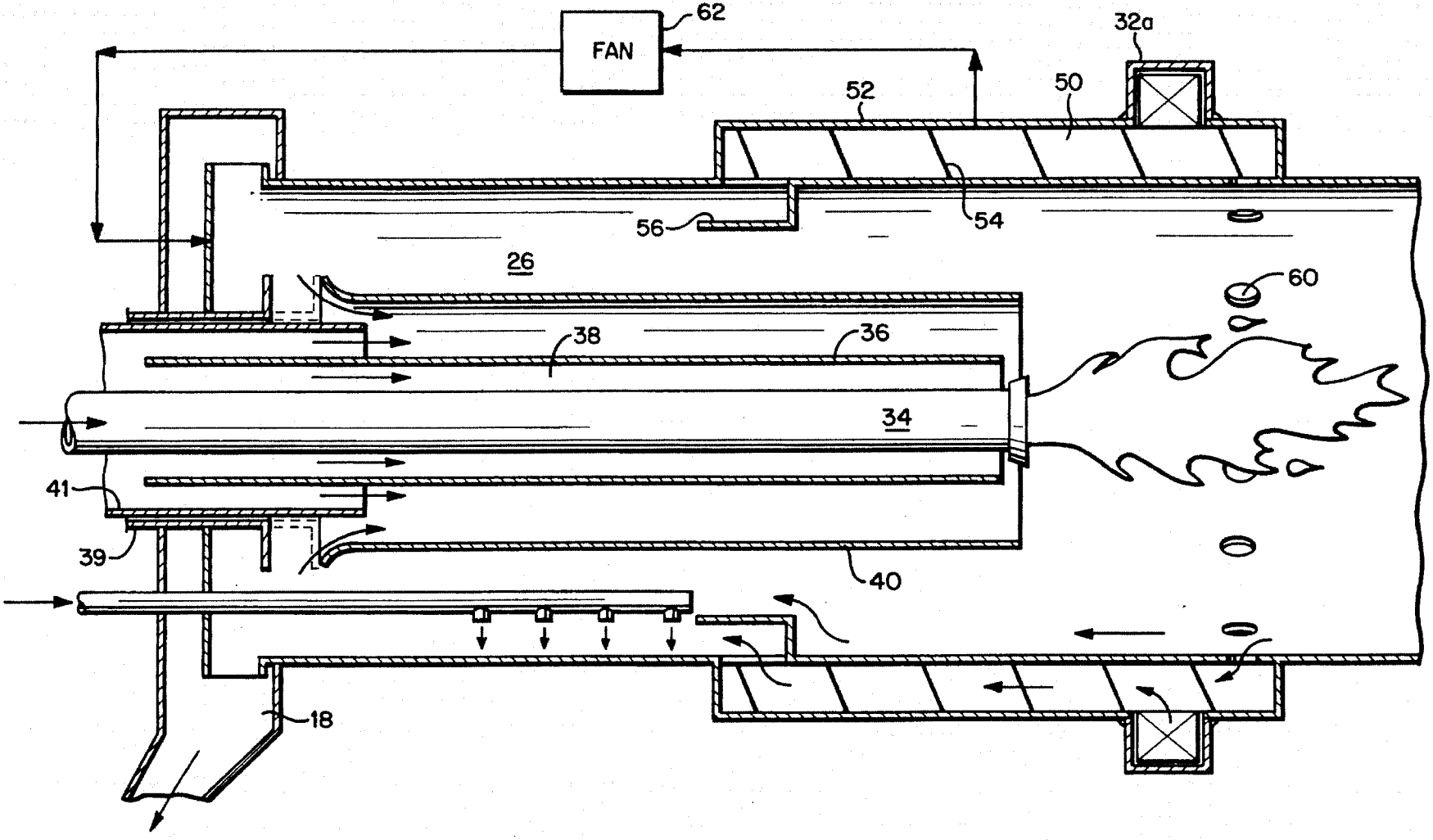
FIG. 3 is a view similar to FIG. 1 illustrating the introduction of RAP into a preheat chamber and mixing the RAP with aggregate in the preheat chamber.

While it is advantageous to preheat the RAP, the RAP may tend to stick to the wall of the preheat chamber, forming a carbonaceous deposit inhibiting heat transfer. It may also cause oversized chunks of RAP in the final mix. To preclude these problems and as illustrated in FIG. 3, the RAP may be mixed with a portion of the hot and dried virgin aggregate from the drying chamber. In this form, the preheat chamber 50 is formed along the outside of the drum by a concentric spaced outer wall 52 closed at its opposite ends to the drum. Within the chamber is a continuous spiral flighting 54 for flowing the RAP from the RAP inlet 32*a* to the RAP outlet 56 of the preheat chamber 50 as the drum rotates. To prevent the formation of RAP deposits within the preheat chamber, a series of circumferentially spaced openings 60 are provided in the drum wall upstream of the RAP inlet 32*a*. Thus, a portion of the hot and dried virgin aggregate flowing through the drying chamber flows through the holes 60 into the preheat chamber 50, where the hot aggregate is mixed with the RAP as the combined mixture flows toward the outlet 56 and into the mixing chamber. As the hot virgin aggregate mixes with the RAP in the chamber 50, the RAP is preheated by the heat transferred thereto from the hot virgin aggregate. With some aggregates and RAP material, the dust returned from the exhaust system or supplemental mineral filler may be added to the RAP to prevent the RAP from sticking to the walls and preclude the need for the aggregate addition.

Figure 4:
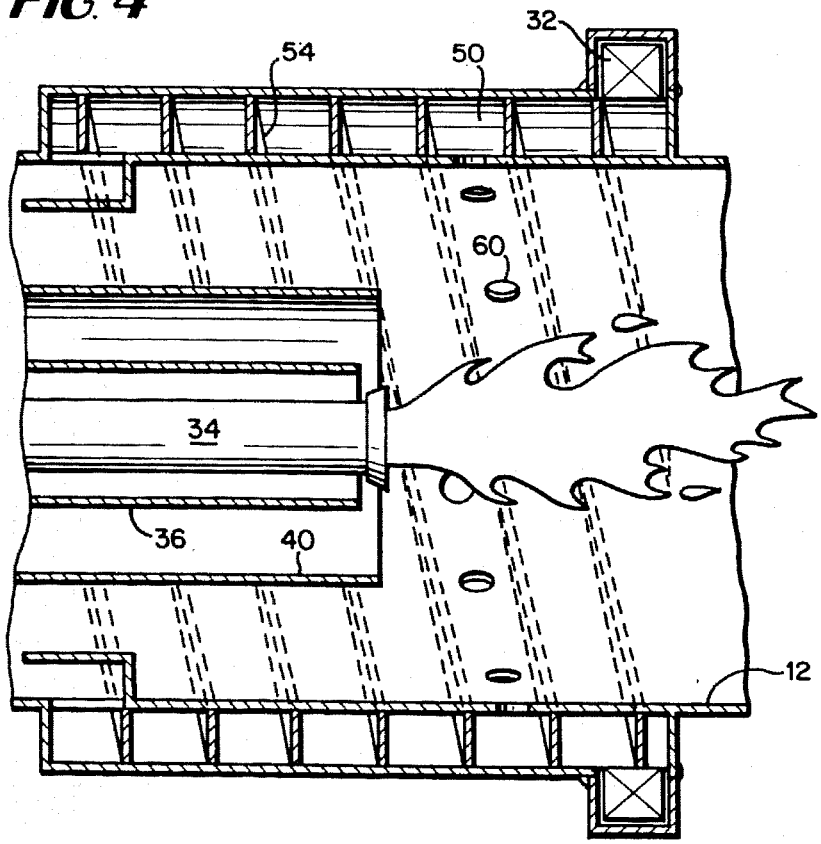
FIG. 4 is a view similar to FIG. 1 illustrating a further embodiment of preheat chamber for the RAP and aggregate.

It has also been found important, however, to preclude the gases evolving from the RAP as it is preheated in chamber 50 from escaping the preheat chamber through the aggregate inlet ports 60 into the drying section which would cause pollution problems. To accomplish this, the ports 60 are located upstream of the RAP entry port 32*a*. Alternatively, as illustrated in FIG. 4, the ports 60 can be located on the backside of the spiral flighting 54 such that the virgin aggregates would be pushed down the drum on one side of the sweep of the flights and the RAP entry would be on the opposite sides of the sweep. This also maintains the virgin aggregates from falling out the RAP inlet. The spiral flighting 54 need not be continued throughout the length of the annulus but could extend only through a transition zone, leaving the balance of the preheat chamber free of flights or provided with lifting flights. The lifting flights are particularly useful to fold the material against the inner drum surface for better heat transfer.

In order to maintain the gases evolving from the RAP preheating in chamber 50 from exiting through the virgin aggregate ports 60 into the drying chamber, the preheat chamber 50 may be maintained under a more negative pressure than the pressure within the flame zone in the dryer section. To accomplish this, a fan 62 (FIG. 3) may be employed to suction gases from the preheat chamber 50 and inject those gases into the mixing chamber 26 for subsequent elimination of the gases as they pass through the dryer flame with the balance of the gases that evolve in the mixing chamber.

Figure 5:
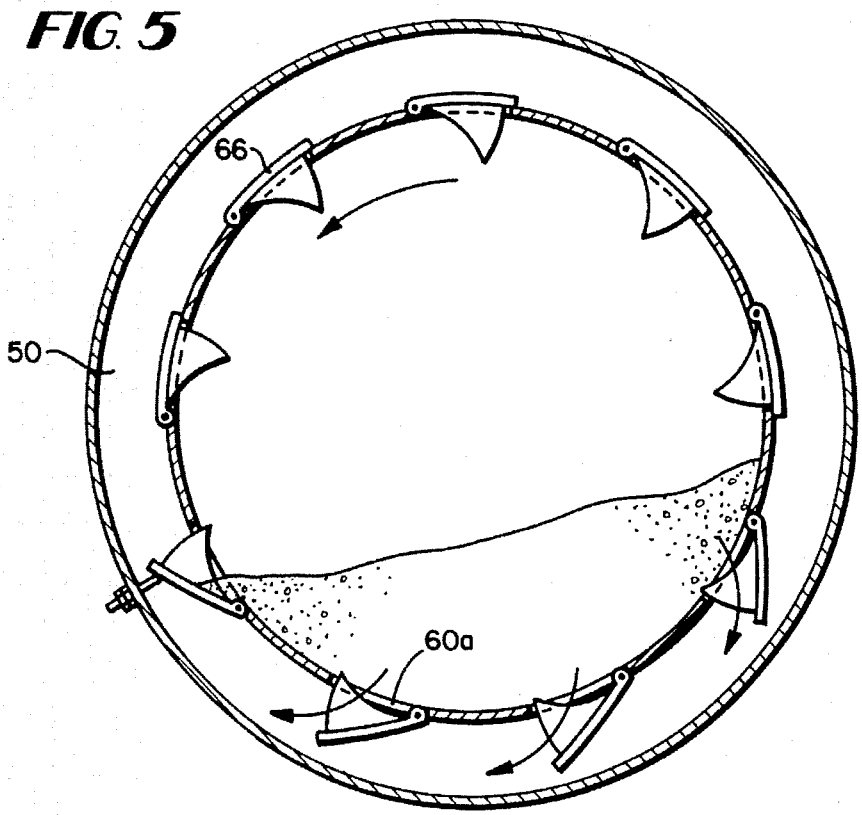
FIGS. 5–9A illustrate various forms of the invention for mixing hot and dry aggregate with RAP in the preheat chamber while simultaneously preventing flow of gases from the preheat chamber to the drying section.

In an alternate embodiment for preventing the gases from the RAP preheating in chamber 50 from reaching the dryer section, hinged doors (FIG. 5) can be disposed to open and close the virgin aggregate inlets 60. Thus, doors 66 are hinged and arranged in accordance with the direction of rotation of the drum to open as the doors are rotated into their lowermost positions with the aggregate within the drum passing through the openings 60*a* and the open doors into the preheat chamber 50. As the drum rotates, for example, in the counterclockwise direction illustrated in FIG. 5, the doors 66 pivot to a closed position generally at an elevation within the drum corresponding to the level of the bed of aggregate along the lower side of the drum thereby preventing communication of gases between the preheat chamber 50 and the drying chamber. An adjustable stop, not shown, may be placed on each door to limit the size of the opening for the virgin aggregate to flow into the preheat chamber 50.

Figure 6:
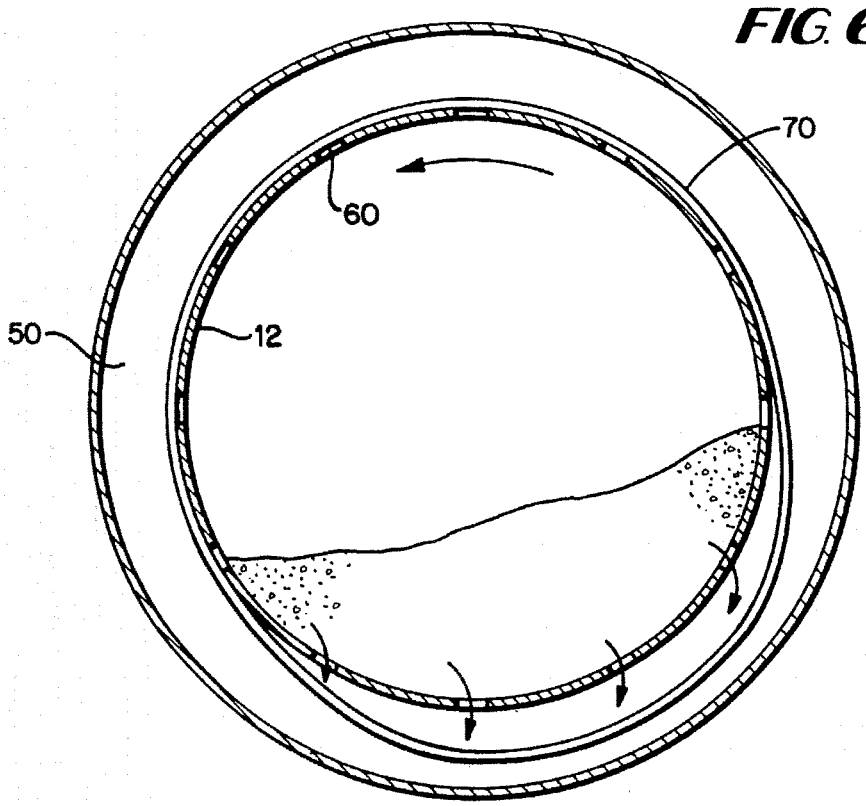

Referring now to FIG. 6, there is illustrated another form of valving structure for precluding communication of gases between the preheat chamber and the drying chamber. In this form, an oblate cylindrical section 70 larger in diameter than the diameter of the drum forming the drying section but smaller in diameter than the outer wall of the preheat chamber, hangs loose in the preheat chamber from the drum wall. The loose ring 70 overlies the ports 60 between the drying chamber and the preheat chamber. The ring 70, as the drum rotates, rides up the drum to open the ports 60 in the area of the drying chamber where the virgin aggregate forms the bed in the chamber. Thus, the virgin aggregate flows through the ports 60 into the preheat chamber 50 while the seal ring 70 closes or overlies the remaining ports open to the drying chamber. The flow of virgin aggregate through the open ports precludes backflow of gases from the preheat chamber into the drying chamber.

Preferably, the ring 70 is formed of a flexible material such as thin gauge stainless steel which would droop when installed. This would enable the ring to conform to the drum giving an oblong or oblate cylindrical shape as illustrated in FIG. 6. The weight of the aggregate on the seal ring 70 would also tend to force it to conform to the cylindrical drum configuration, efficiently sealing the openings on the top and sides of the drum. The virgin aggregate entering the preheat chamber flows toward the lower end of the drum by virtue of the drum inclination. Stops, not shown, may be employed to prevent the loose seal ring 70 from moving axially toward the discharge end of the drum with the virgin aggregate and to maintain the ring at an axial position overlying the ports 60.

Figure 7:
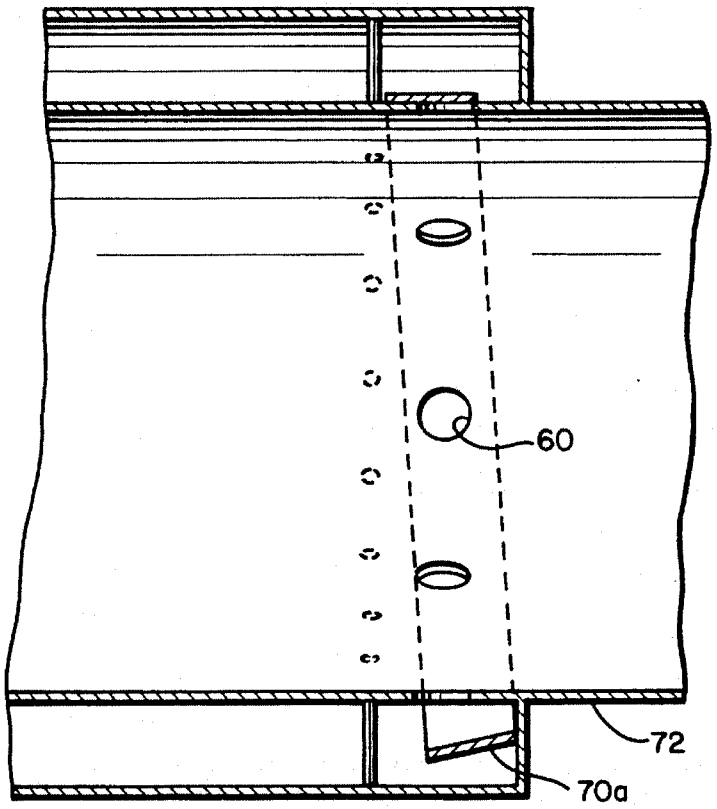

In FIG. 7, the sealing ring 70*a* is tapered, i.e., fabricated in the shape of a frustum of a cone. When disposed about drum 12, the flat inner surface of the tapered ring 70*a* engages the top and sides of the drum to close ports 60. At the bottom of the drum, the ring 70*a* is spaced from ports 60 enabling aggregate to flow from the dryer section into the preheat chamber. Tapered ring 70*a* also facilitates the flow of aggregates from ports 60, toward the discharge end by the inclination of the inner surface of the ring at the bottom of the drum as illustrated.

Figure 8:
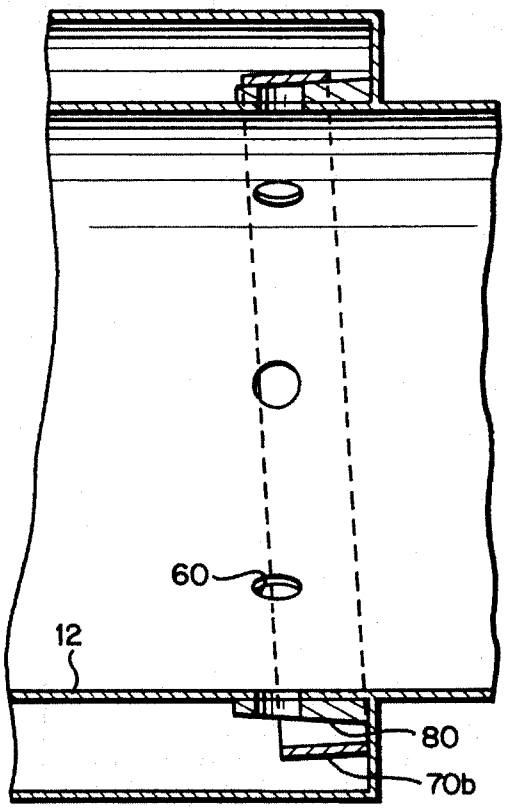

In FIG. 8, instead of a conical or tapered ring 70*a*, the ring 70*b* may be cylindrical with a tapered surface 80 formed on the outer wall of drum 12 of the drying section. The effect is similar to the embodiment of FIG. 7 noted above.

Figure 9A:
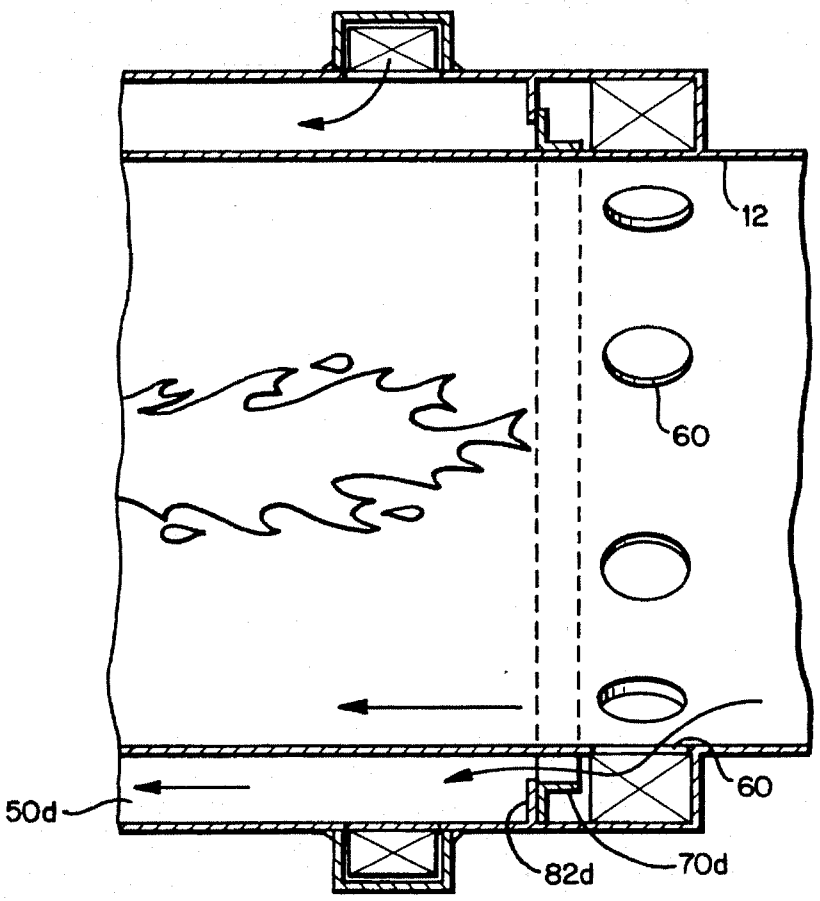
Figure 9:
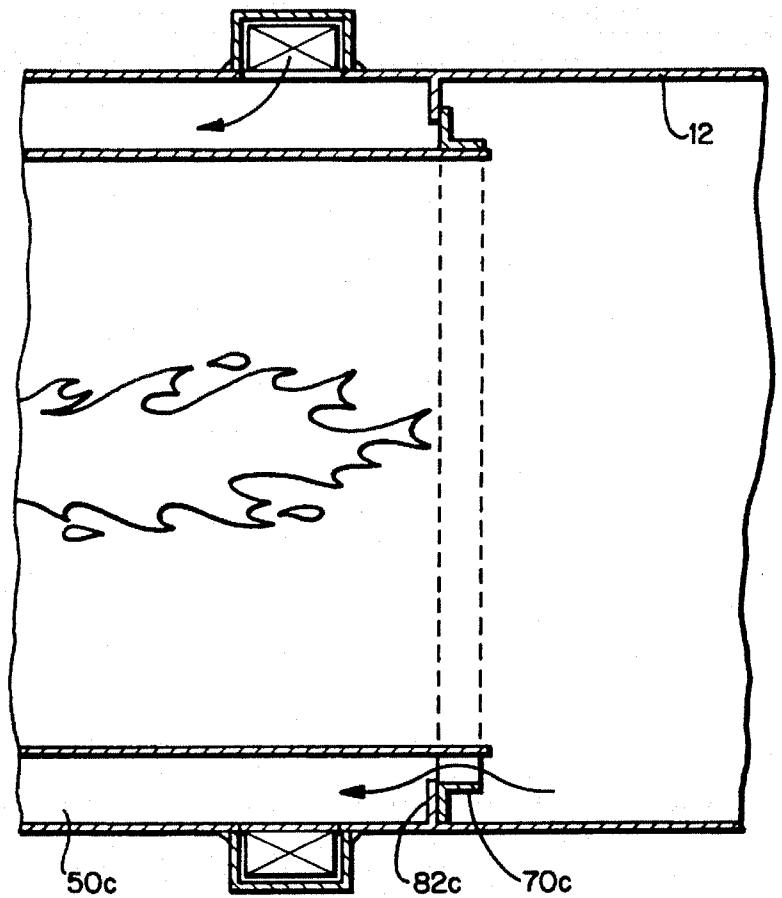

In FIG. 9, there is illustrated an interior preheat chamber 50*c*, while FIG. 9A illustrates an external preheat chamber 50*d*. In both cases, a ring 70*c* or 70*d* having a cross-section in the shape of an angle is employed in conjunction with a flange 82*c* or 82*d*. In the exterior preheat chamber 50*d*, flange 82*d* projects radially inwardly from the outer wall of the drum and in the case of the external preheat chamber, projects radially inwardly from the outer wall of the preheat chamber. These flanges cooperate with the angle-shaped loose ring 70*c* or 70*d* to provide essentially a crescent-shaped passage for the flow of virgin aggregate from ports 60 past the ring at the bottom of the drum. The ring, of course, seals the opening between the flange and the drum wall at the sides and top of the drum, preventing the release of gases from the annular preheat chamber into the drying chamber while permitting flow of aggregate through ports 60 into the preheat chamber for heating and premixing with the RAP inlet to chamber 50.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method for making asphaltic concrete comprising the steps of:

introducing aggregate adjacent a first end of a drum mixer for flow in an axial direction toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer;

establishing a preheating chamber at least in part along said drum between said burner head and said first end of said drum;

introducing recycle asphalt material into said preheating chamber;

preheating the recycle asphalt material in said preheating chamber;

introducing the preheated recycle asphalt material into said mixing chamber;

mixing the preheated recycle asphalt material introduced into said mixing chamber and the heated dried aggregate from the drying chamber in said mixing chamber to form the asphaltic concrete; and causing a portion of the hot gases of combustion to flow from said drying chamber into said mixing chamber.

2. A method according to claim 1 including establishing a pressure differential between said mixing chamber and said drying chamber to cause a portion of the hot gases of combustion to flow from said drying chamber into said mixing chamber in a direction countercurrent to the flow of hot gases of combustion in said drying chamber.

3. A method for making asphaltic concrete comprising the steps of:

introducing aggregate adjacent a first end of a drum mixer for flow toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer;

mixing hot and dried aggregate with asphalt in said mixing chamber to produce asphaltic concrete;

flowing gases from said mixing chamber into a combustion volume generated by said burner head; and preheating air supplied to said burner by providing a preheat chamber about said drum in heat exchange relation with the hot gases of combustion.

4. A method according to claim 3 including supplying the preheated air in a swirl pattern to enhance the efficiency of the burner.

5. A method for making asphaltic concrete comprising the steps of:

introducing aggregate adjacent a first end of a drum mixer for flow in an axial direction toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer to heat and dry the aggregate flowing through the drying chamber;

establishing a preheating chamber at least in part along said drum between said burner head and said first end of said drum;

introducing recycle asphalt material into said preheating chamber;

preheating the recycle asphalt material in said preheating chamber;

introducing the preheated recycle asphalt material into said mixing chamber;

mixing the preheated recycle asphalt material introduced into said mixing chamber and the heated dried aggregate from the drying chamber in said mixing chamber to form the asphaltic concrete;

flowing gases from said mixing chamber into a combustion volume generated by said burner head; and aspirating gases from said mixing chamber by flowing air to the burner head.

6. A method according to claim 5 including controlling the proportion of air and gas from said mixing chamber supplied to said burner.

7. A method for making asphaltic concrete comprising the steps of:

introducing aggregate adjacent a first end of a drum mixer for flow in an axial direction toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer to heat and dry the aggregate flowing through the drying chamber;

establishing a preheating chamber at least in part along said drum between said burner head and said first end of said drum;

introducing recycle asphalt material into said preheating chamber;

preheating the recycle asphalt material in said preheating chamber;

introducing the preheated recycle asphalt material into said mixing chamber;

mixing the preheated recycle asphalt material introduced into said mixing chamber and the heated dried aggregate from the drying chamber in said mixing chamber to form the asphaltic concrete;

flowing gases from said mixing chamber into a combustion volume generated by said burner head; and causing a portion of the hot gases of combustion to flow from said drying chamber into said mixing chamber.

8. A method for making asphaltic concrete comprising the steps of:

introducing aggregate adjacent a first end of a drum mixer for flow in an axial direction toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer to heat and dry the aggregate flowing through the drying chamber;

establishing a preheating chamber at least in part along said drum between said burner head and said first end of said drum;

introducing recycle asphalt material into said preheating chamber;

preheating the recycle asphalt material in said preheating chamber;

introducing the preheated recycle asphalt material into said mixing chamber;

mixing the preheated recycle asphalt material introduced into said mixing chamber and the heated dried aggregate from the drying chamber in said mixing chamber to form the asphaltic concrete;

flowing gases from said mixing chamber into a combustion volume generated by said burner head; and establishing a pressure differential between said mixing chamber and said drying chamber to cause a portion of the hot gases of combustion to flow from said drying chamber into said mixing chamber in a direction countercurrent to the flow of hot gases of combustion in said drying chamber.

9. A method for making asphaltic concrete comprising the steps of:

introducing aggregate adjacent a first end of a drum mixer for flow in an axial direction toward a second opposite end of said drum mixer;

locating a burner head within said drum mixer intermediate said drum ends defining a drying chamber for the aggregate between said burner head and said first end of said drum mixer and a mixing chamber between said burner head and said second end of said drum mixer;

generating hot gases of combustion at said burner head for flow through said drying chamber countercurrently to the flow of aggregate through said drum mixer to heat and dry the aggregate flowing through the drying chamber;

establishing a preheating chamber at least in part along said drum between said burner head and said first end of said drum;

introducing recycle asphalt material into said preheating chamber;

preheating the recycle asphalt material in said preheating chamber;

introducing the preheated recycle asphalt material into said mixing chamber;

mixing the preheated recycle asphalt material introduced into said mixing chamber and the heated dried aggregate from the drying chamber in said mixing chamber to form the asphaltic concrete;

flowing gases from said mixing chamber into a combustion volume generated by said burner head; and including introducing dust into said recycle asphalt material prior to introducing the recycle asphalt material to said mixing chamber to prevent the recycle asphalt material from sticking during preheating to the walls of the preheating chamber.

* * * * *